US006536542B1

(12) United States Patent
Fang et al.

(10) Patent No.: US 6,536,542 B1
(45) Date of Patent: Mar. 25, 2003

(54) ROCK BIT SEAL WITH MULTIPLE DYNAMIC SEAL SURFACE ELEMENTS

(75) Inventors: Zhigang Fang, The Woodlands, TX (US); Chris Cawthorne, The Woodlands, TX (US); Nephi M. Mourik, The Woodlands, TX (US); Sujian Huang, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/428,878

(22) Filed: Oct. 28, 1999

(51) Int. Cl.[7] ..... E21B 10/22; F16J 15/34
(52) U.S. Cl. ..... 175/371; 175/372; 277/399
(58) Field of Search ..... 175/371, 372, 175/374; 277/382, 399, 404, 406

(56) References Cited

U.S. PATENT DOCUMENTS 3,449,024 A * 6/1969 Lichte ..... 166/371 X
4,666,001 A * 5/1987 Burr ..... 175/371
5,360,076 A * 11/1994 Kelly, Jr. et al. ..... 175/371
5,362,073 A 11/1994 Upton et al.
5,791,421 A * 8/1998 Lin ..... 175/371
5,842,700 A 12/1998 Fang et al.
5,842,701 A 12/1998 Cawthorne et al.
5,944,125 A * 8/1999 Byrd ..... 175/371
6,026,917 A * 2/2000 Zahradnik et al. ..... 175/371

* cited by examiner

*Primary Examiner*—Frank Tsay
(74) *Attorney, Agent, or Firm*—Grant T. Langton, Esq.; Jeffer, Mangels, Butler & Marmaro LLP

(57) ABSTRACT

Seals of this invention comprise an annular elastomeric ring-shaped body having a dynamic surface disposed along a first body portion, the dynamic surface comprising at least two surface elements that project outwardly therefrom to provide multiple barriers to fluid and debris migration thereacross when placed into contact with a rock bit rotary dynamic surface. The seal dynamic surface includes a recessed portion disposed between the surface elements, and a static seal surface disposed along a second body portion. At least one of the surface elements includes a wear surface that is formed from a material that is more wear resistant than materials that are used to form a remaining portion of the seal. A preferred wear surface is one formed from a composite material comprising a fabric of nonelastomeric polymeric material that is bonded together with an elastomeric material. Seals of this invention provide improved properties of both wear resistance and sealability when compared to conventional seals having a single dynamic seal surface.

67 Claims, 6 Drawing Sheets

70
52
57
55
56
74
57
72
54
68

76
74
52
78
55
56
54
68

80
74
78
55
56
72
54

82
52
86
84
55
56
88
54

90
55
58
72
54

92
55
58
54

70
96
94

ROCK BIT SEAL WITH MULTIPLE DYNAMIC SEAL SURFACE ELEMENTS

FIELD OF THE INVENTION

This invention relates to a seal for retaining lubricant around a journal bearing in a rock bit or drill bit for drilling oil wells or the like. More particularly, this invention relates to seal rings having a dynamic seal surface profile that is constructed with at least two contact pressure maximas that form multiple barriers to control the passage of grease and/or drilling fluid thereacross, thereby providing optimal properties of sealability and wear resistance to maximize seal service life.

BACKGROUND OF THE INVENTION

Rock bits are employed for drilling wells, blast holes, or the like in subterranean formations for oil, gas, geothermal steam, minerals, and the like. Such drill bits have a body connected to a drill string and a plurality, typically three, of hollow cutter cones mounted on the body for drilling rock formations. The cutter cones are mounted on steel journals or pins integral with the bit body at its lower end. In use, the drill string and/or the bit body are rotated in the bore hole, and each cone is caused to rotate on its respective journal as the cone contacts the bottom of the bore hole being drilled. High temperatures and pressures are often encountered when such rock bits are used for drilling in deep wells.

When a drill bit wears out or fails as a bore hole is being drilled, it is necessary to withdraw the drill string for replacing the bit. The amount of time required to make a round trip for replacing a bit is essentially lost from drilling operations. This time can become a significant portion of the total time for completing a well, particularly as the well depths become great. It is therefore quite desirable to maximize the service life of a drill bit in a rock formation. Prolonging the time of drilling minimizes the time lost in "round tripping" the drill string for replacing the bits. Replacement of a drill bit can be required for a number of reasons, including wearing out or breakage of the structure contacting the rock formation.

One reason for replacing the rock bits include failure or severe wear of the journal bearings on which the cutter cones are mounted. These bearings can be friction- or roller-type bearings, and can be subject to high loads, high hydrostatic pressures in the hole being drilled, high temperatures due to drilling, elevated temperatures in the formation being drilled, as well as harmful abrasive particles originating from the formation being drilled. The journal bearings are lubricated with grease adapted to such severe conditions. Such lubricants are a critical element in the life of a rock bit. A successful grease should have a useful life longer than other elements of the bit so that premature failures of bearings do not unduly limit drilling.

The grease is retained within the rock bit to lubricate the journal bearings by a journal bearing seal, typically an O-ring type of seal. The seal must endure a range of temperature and pressure conditions during the operation of the rock bit to prevent the grease from escaping and/or contaminants from entering the bearing and, thereby ensure that the journal bearings are sufficiently lubricated. Elastomer seals known in the art are conventionally formed from a single type of rubber or elastomeric material, and are generally formed having identically configured dynamic and static seal surfaces, i.e., having symmetrically configured sealing surfaces. The rubber or elastomeric material selected to form such a seal has particular hardness, modulus of elasticity, wear resistance, temperature stability, and coefficient of friction. Additionally, the particular geometric configuration of the seal surfaces produces a given amount of seal deflection that defines the degree of contact pressure or "squeeze" applied by the dynamic and static seal surfaces against respective journal bearing and cone surfaces.

The wear, temperature, and contact pressure conditions that are encountered at the dynamic seal surface are different than those encountered at the static seal surface. Therefore, the type of seal material and seal geometry that is ultimately selected to form both seal surfaces represents a compromise between satisfying the operating conditions that occur at the different dynamic and static seal surfaces. Because of the different operating conditions at each seal surface, conventional seals formed from a single-type of material, having symmetrically configured sealing surface, often display poor wear resistance and poor temperature stability at the dynamic seal surface where wear and temperature conditions, under high-temperature operating conditions, are the most aggressive. Accordingly, the service life of rock bits that contain such seals are defined by the limited capability of the seal itself.

U.S. Pat. No. 5,842,701 discloses a seal ring used within a rotary cone rock bit that has a static seal surface that is smaller in radius than a dynamic seal surface, i.e., a seal ring that is asymmetric. The seal ring dynamic seal surface is designed having a continuous surface, i.e., one that is in continuous contact with an adjacent rock bit dynamic surface when moving axially therealong. The seal ring is designed in this manner to provide contact forces against adjacent static and dynamic rock bit surfaces that are best suited for the different operating conditions at each such surface. Additionally, the seal ring can include a dynamic seal surface that formed from a material that is different than that of the static seal surface to further enable the seal ring to meet the specific operating conditions at each static and dynamic surface.

U.S. Pat. No. 5,842,700 discloses a seal ring used within a rotary cone rock bit that includes a dynamic seal surface that is formed from a material different than the static seal surface. The dynamic seal surface is formed from a composite material that provides improved wear resistance when compared to a non-composite elastomer. The dynamic seal surface is formed from a nonelastomeric polymeric fabric material that is specially designed to enhance the wear life of the seal when positioned adjacent the rock bit dynamic surface.

When designing seals for use in such applications it is desirable to optimize not only the property of wear resistance but sealability, i.e., the ability of the seal to retain lubricant with the rock bit journal and prevent drilling fluid from entering the rock bit journal. Typically, improvements in seal ring wear life provide compromised sealability and visa versa. While the above-described seal rings do provide an improved degree of wear resistance when compared to other seal rings, improvements in sealability are still desired.

It is, therefore, desired that journal bearing seals be designed to optimize properties of both wear resistance and sealability. It is additionally desired that such journal bearing seals be designed to enable their use without the need to unduly modify the application device, e.g., existing seal cavity, to permit their retrofit use in a number of existing applications.

SUMMARY OF THE INVENTION

There is, therefore, provided in practice of this invention a seal ring having a dynamic seal surface comprising multiple surface elements that are configured to provide multiple barriers to the migration of grease and/or drilling fluid thereacross. A related characteristic of seal rings of this invention is that the dynamic seal surface comprise more than one contact pressure profile maxima when installed within a rock bit against a rock bit rotary dynamic surface.

Seal rings of this invention comprises an annular elastomeric ring-shaped body comprising a dynamic seal surface, disposed along a first body portion, having at least two outwardly projecting surface elements, and a static seal surface disposed along a second body portion. The seal dynamic seal surface can be disposed along the seal outside diameter or inside diameter, in the case where the seal ring is a radial sealing element, or the seal dynamic seal surface can be disposed along either seal axial surface, in the case where the seal ring is an axial sealing element. The dynamic seal surface elements are separated by a recessed portion, or discontinuity, that extends around the seal dynamic surface and that may or may not be visible once the seal is installed within the rock bit.

At least a portion of the dynamic seal surface, e.g., at least a portion of one of the surface elements, can be formed from a material different from that used to form the seal body. In an example embodiment, a wear surface of one of the surface elements is formed from a material that is more wear resistant than that used to form the remaining seal dynamic surface and/or the remaining seal body. In a preferred embodiment, the wear surface is formed from a composite material comprising a fabric of nonelastomeric polymeric material that is bonded together with an elastomeric material.

Additional embodiments of seals of this invention include those where: (1) the seal is formed entirely from a single-type of elastomeric material; (2) the seal comprises a seal body formed from a material different than that of the dynamic seal surfaces; and (3) the seal comprises a seal body formed from a material different than that both of the dynamic seal surfaces and the static seal surface.

A seal construction comprising projecting dynamic seal surface elements is advantageous when compared to conventional seals having a single dynamic seal surface element because each independent projecting element can be tailored both in size/shape and in the material of construction to provide particular dynamic sealing characteristics at each respective rock bit rotary dynamic surface. For example, the surface elements can be configured to each provide a particular barrier function, by producing a particular contact pressure against a respective surface of the rock bit, to complement the different operating conditions along the rock bit dynamic surface, thereby optimizing sealability. Additionally, the surface elements can be formed from the same or different materials that are selected to better accommodate the different temperature and wear conditions that exist at each edge portion of the rock bit dynamic surface during the drilling operation, thereby optimizing wear resistance.

Further, seal constructions comprising multiple dynamic surface elements include a recessed portion that can be designed to retain grease therein, when the seal is installed within the rock bit, to further reduce friction-related wear, which feature is not provided by conventional seal constructions comprising only a single surface element. The recessed dynamic surface portion can also be designed to act as a buffer zone to prevent the unwanted passage of fluids between dynamic surface elements and into or out of the rock bit. Thus, the seal dynamic surface elements and recessed portion act together to provide improved resistance to migration of fluid thereacross, thereby providing improved sealability.

For these reasons, seals constructed according to this invention are well adapted to accommodate the different operating conditions and sealing requirements that exist both at the dynamic and static surfaces of the seal to ensure optimal seal performance and, thereby enhance the service life of rock bits that contain such seals.

DESCRIPTION OF THE DRAWINGS

These and other features and advantages of the invention will become appreciated as the same becomes better understood with reference to the specification, claims and drawings wherein:

DETAILED DESCRIPTION

Figure 1:
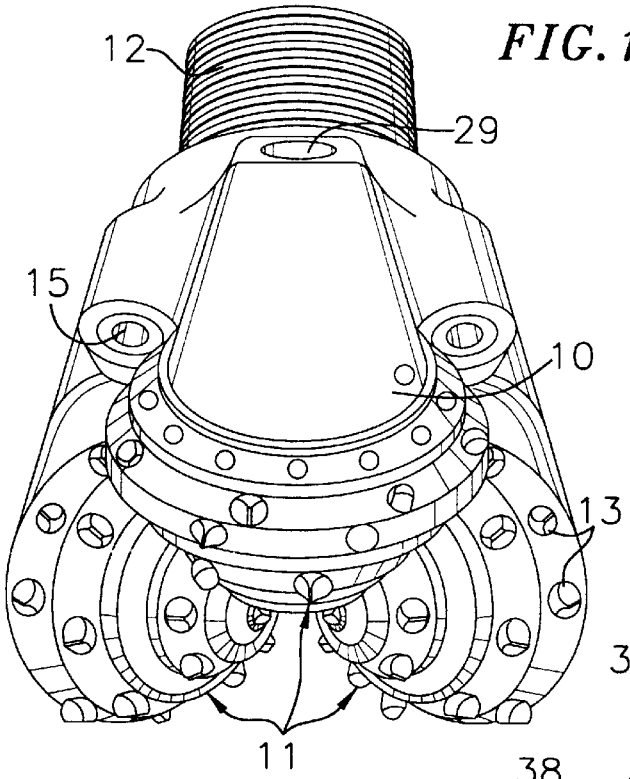
FIG. 1 is a semi-schematic perspective view of a rock bit containing a rock bit seal constructed according to the principles of this invention.

A rock bit employing a seal having multiple dynamic seal surface projections constructed according to principles of this invention comprises a body 10 having three cutter cones 11 mounted on its lower end, as shown in FIG. 1. A threaded pin 12 is at the upper end of the body for assembly of the rock bit onto a drill string for drilling oil wells or the like. A plurality of tungsten carbide inserts 13 are pressed into holes in the surfaces of the cutter cones for bearing on the rock formation being drilled. Nozzles 15 in the bit body introduce drilling fluid into the space around the cutter cones for cooling and carrying away formation chips drilled by the bit.

Generally, seals constructed according to principles of this invention comprise a ring-shaped annular seal body having differently configured static and dynamic seal surfaces. The seal includes more than one surface element that each project outwardly from the dynamic seal surface and that are designed to improve the sealability of the seal. Additionally, the one or more seal dynamic surface elements can be formed from materials that are different from that of the seal body and/or seal static seal surface to improve the wear resistance and/or sealing characteristics of the seal. The materials selected for forming the seal static and dynamic seal surfaces are each designed to provide a balance between seal deflection and contact pressure to maximize seal performance at each surface during operation. The seal materials are additionally selected to provide properties of wear resistance, hardness, reduced friction, and temperature stability that complement the different operating conditions at each static and dynamic surface during operation.

Figure 2:
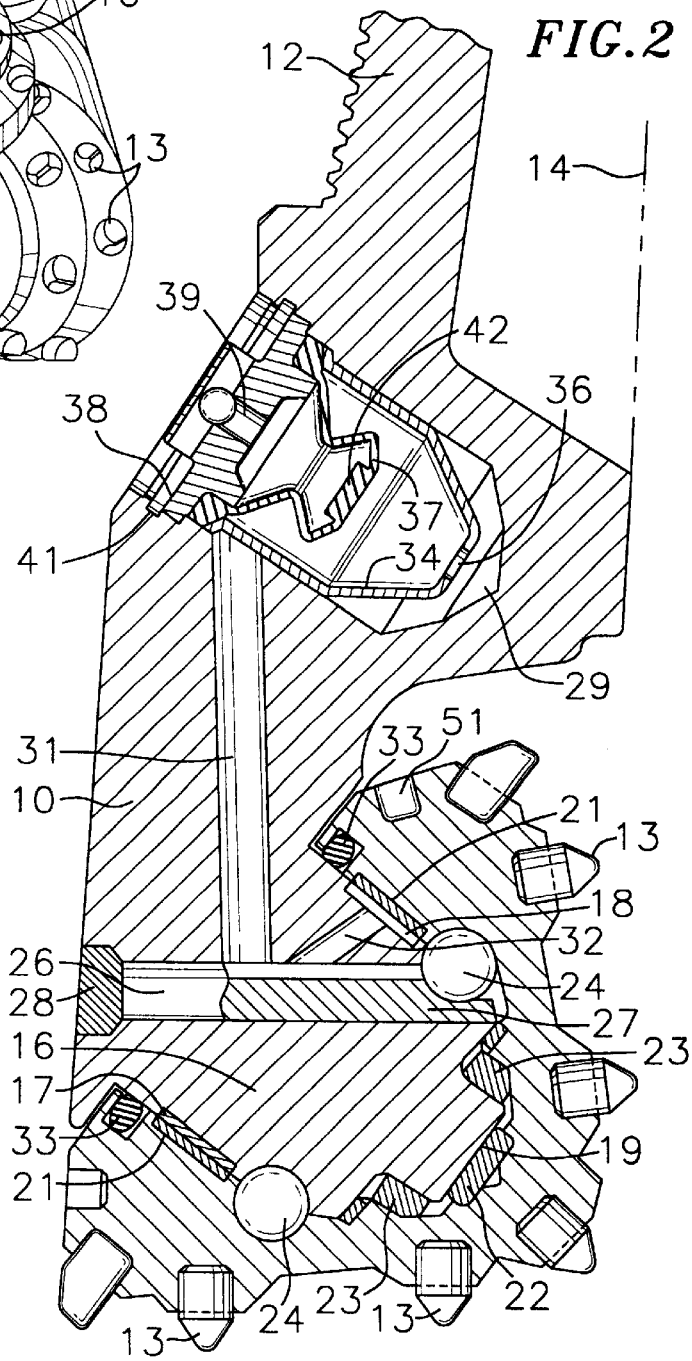
FIG. 2 is a partial cross-sectional view of the rock bit illustrated in FIG. 1.

FIG. 2 is a fragmentary, longitudinal cross-section of the rock bit, extending radially from the rotational axis 14 of the rock bit through one of the three legs on which the cutter cones 11 are mounted. Each leg includes a journal pin extending downwardly and radially, inwardly on the rock bit body. The journal pin includes a cylindrical bearing surface having a hard metal insert 17 on a lower portion of the journal pin. The hard metal insert is typically a cobalt or iron-based alloy welded in place in a groove on the journal leg and having a substantially greater hardness that the steel forming the journal pin and rock bit body.

An open groove 18 is provided on the upper portion of the journal pin. Such a groove may, for example, extend around 60 percent or so of the circumference of the journal pin, and the hard metal insert 17 can extend around the remaining 40 percent or so. The journal pin also has a cylindrical nose 19 at its lower end.

Each cutter cone 11 is in the form of a hollow, generally-conical steel body having cemented tungsten carbide inserts 13 pressed into holes on the external surface. For long life, the inserts may be tipped with a polycrystalline diamond layer. Such tungsten carbide inserts provide the drilling action by engaging a subterranean rock formation as the rock bit is rotated. Some types of bits have hard-faced steel teeth milled on the outside of the cone instead of carbide inserts.

The cavity in the cone contains a cylindrical bearing surface including an aluminum bronze insert 21 deposited in a groove in the steel of the cone or as a floating insert in a groove in the cone. The aluminum bronze insert 21 in the cone engages the hard metal insert 17 on the leg and provides the main bearing surface for the cone on the bit body. A nose button 22 is between the end of the cavity in the cone and the nose 19 and carries the principal thrust loads of the cone on the journal pin. A bushing 23 surrounds the nose and provides additional bearing surface between the cone and journal pin. Other types of bits, particularly for higher rotational speed applications, have roller bearings instead of the exemplary journal bearings illustrated herein. It is to be understood that dual functioning seals constructed according to principles of this invention may be used with rock bits comprising either roller bearings or conventional frictional journal bearings.

A plurality of bearing balls 24 are fitted into complementary ball races in the cone and on the journal pin. These balls are inserted through a ball passage 26, which extends through the journal pin between the bearing races and the exterior of the rock bit. A cone is first fitted on the journal pin, and then the bearing balls 24 are inserted through the ball passage. The balls carry any thrust loads tending to remove the cone from the journal pin and thereby retain the cone on the journal pin. The balls are retained in the races by a ball retainer 27 inserted through the ball passage 26 after the balls are in place. The retainer 27 is then welded 28 at the end of the ball passage to keep the ball retainer in place. The bearing surfaces between the journal pin and the cone are lubricated by a grease. Preferably, the interior of the rock bit is evacuated, and grease is introduced through a fill passage (not shown). The grease thus fills the regions adjacent the bearing surfaces plus various passages and a grease reservoir, and air is essentially excluded from the interior of the rock bit. The grease reservoir comprises a cavity 29 in the rock bit body, which is connected to the ball passage 26 by a lubricant passage 31. Grease also fills the portion of the ball passage adjacent the ball retainer, the open groove 18 on the upper side of the journal pin, and a diagonally extending passage 32 therebetween. Grease is retained in the bearing structure by a resilient seal in the form of a ring 33 between the cone and journal pin.

A pressure compensation subassembly is included in the grease reservoir 29. The subassembly comprises a metal cup 34 with an opening 36 at its inner end. A flexible rubber bellows 37 extends into the cup from its outer end. The bellows is held into place by a cap 38 with a vent passage 39. The pressure compensation subassembly is held in the grease reservoir by a snap ring 41.

A When the rock bit is filled with grease, the bearings, the groove 18 on the journal pin, passages in the journal pin, the lubrication passage 31, and the grease reservoir on the outside of the bellows 37 are filled with grease. If the volume of grease expands due to heating, for example, the bellows 37 is compressed to provide additional volume in the sealed grease system, thereby preventing accumulation of excessive pressures. High pressure in the grease system can damage the seal 33 and permit drilling mud or the like to enter the bearings. Such material is abrasive and can quickly damage the bearings. Conversely, if the grease volume should contract, the bellows can expand to prevent low pressures in the sealed grease system, which could cause flow of abrasive and/or corrosive substances past the seal.

The bellows has a boss 42 at its inner end which can seat against the cap 38 at one end of the displacement of the bellows for sealing the vent passage 39. The end of the bellows can also seat against the cup 34 at the other end of its stroke, thereby sealing the opening 36. If desired, a pressure relief check valve can also be provided in the grease reservoir for relieving over-pressures in the grease system that could damage the seal. Even with a pressure compensator, it is believed that occasional differential pressures may exist across the seal of over 150 psi (550 kilopascals).

To maintain the desired properties of the seal at the pressure and temperature conditions that prevail in a rock bit, to inhibit "pumping" of the grease through the seal, and for a long useful life, it is important that the seal be resistant to crude oil and other chemical compositions found within oil wells, have a high heat and abrasion resistance, have low rubbing friction, and not be readily deformed under the pressure and temperature conditions in a well which could allow leakage of the grease from within the bit or drilling mud into the bit.

A variety of seals have been employed in such rock bits, such as O-ring type seals, high aspect ratio seals, and other seal configurations having symmetrical static and dynamic seal surfaces. Such seals are conventionally formed from a single type of homogeneous rubber or elastomeric material, such as acrylonitrile polymers or acrylonitrile/butadiene copolymers. The rubber material that is selected to form the seal has particular properties of hardness, modulus, wear resistance, tensile strength, friction resistance, and temperature stability under operating conditions. Such seals generally include a dynamic seal surface and a static seal surface that are placed into contact with respective rotating and stationary rock bit surfaces, and that are subject to different operating conditions at each surface. The main body portion of a seal, between the contact surfaces, acts as an energizer to keep the contact surfaces engaged with respective sealing elements on the rock bit.

Because each dynamic seal surface is exposed to operating conditions of pressure and temperature that are different from those occurring at the static seal surface, seals that are formed from a single type of material are necessarily not perfectly suited to meet the operating conditions at each surface. Thus, the single type of material that is selected to form the seal represents a compromise between meeting the operating conditions at both seal surfaces. This compromise either results in the failure of the seal at the dynamic seal surface, from the selected seal material being too soft or not sufficiently wear resistant to withstand the high wear and temperature conditions occurring at the dynamic seal surface, or failure at the static seal surface from the selected seal material being too hard and not sufficiently deformable to maintain a stationary position against an adjacent rock bit surface.

Additionally, seals known in the art employed in rock bits are configured having a dynamic seal surface having a constant radius or that is planar when viewed across a profile of the surface before it is installed within the rock bit. This type of seal is designed to provide a single continuous contact area against an adjacent dynamic rock bit surface. It is desirable that any such seal placed into rock bit service not only resist wear along the dynamic seal surface but provide a liquid-tight seal against the adjacent dynamic rock bit surface to: (1) prevent drilling fluid from passing therebetween to either cause abrasive seal wear at the dynamic seal surface or at the rock bit journal bearing after passing across the seal; and (2) prevent lubricant used to lubricate the journal bearing from passing across the seal and out of the rock bit.

When dealing with such conventional seals having a single continuous dynamic seal surface, properties of improved wear resistance are achieved with compromised sealability. For example, a seal can be designed to have improved properties of wear resistance by either reducing the contact force at the dynamic seal surface or forming the dynamic seal surface from a material having desired properties of wear resistance. However, in each case the seal so formed will have reduced properties of sealability. Alternatively, a seal can be designed to have improved properties of sealability by either increasing the contact force at the seal surface or forming the dynamic seal surface formed from a material having desired properties of deflection, e.g., one that is more easily deflected to form a more perfect seal against the adjacent rock bit dynamic surface. However, such a seal will have reduced properties of wear resistance.

Generally speaking, all seal embodiments of this invention comprise an annular or ring-shaped seal body having a dynamic seal surface, disposed along a portion of the body, that includes more than one projecting dynamic surface element, and a static seal surface disposed along another portion of the seal body. The dynamic seal surface can be disposed along the inside or outside diameter of the seal body, in the event that the seal is placed into a radial sealing service, or can be disposed along an axial surface of the seal body, in the event that the seal is placed into an axial sealing service.

Figure 3:
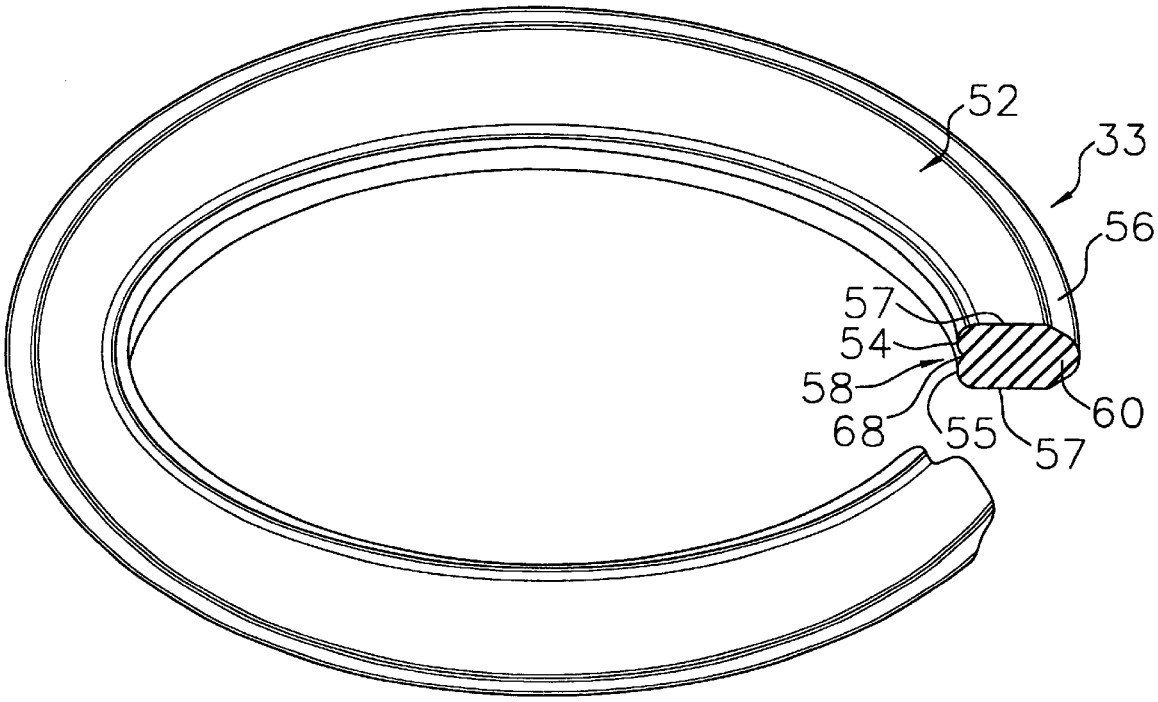
FIG. 3 is a perspective view of a first seal embodiment constructed according to principles of this invention.

FIG. 3, for example, illustrates a first seal embodiment 33, constructed according to principles of this invention for use in a radial sealing service. The seal 33 has an annular ring-shaped seal body 52 that can either be formed from a single type of rubber or elastomeric material 60, or from more than one type of rubber or elastomeric material each selected to best meet the different operating conditions at the different seal surfaces. The seal body 52 comprises a static seal surface 56 disposed along an outside seal body diameter, and dynamic seal surface 58 disposed along an inside seal body diameter that includes dynamic surface elements 54 and 55 that each project outwardly therefrom. The dynamic surface elements 54 and 55 provide a substantially noncontinuous surface, i.e., a surface comprising two or more radii of curvature, when viewed axially thereacross between axial seal body surfaces 57 before being installed within a rock bit.

Figure 4:
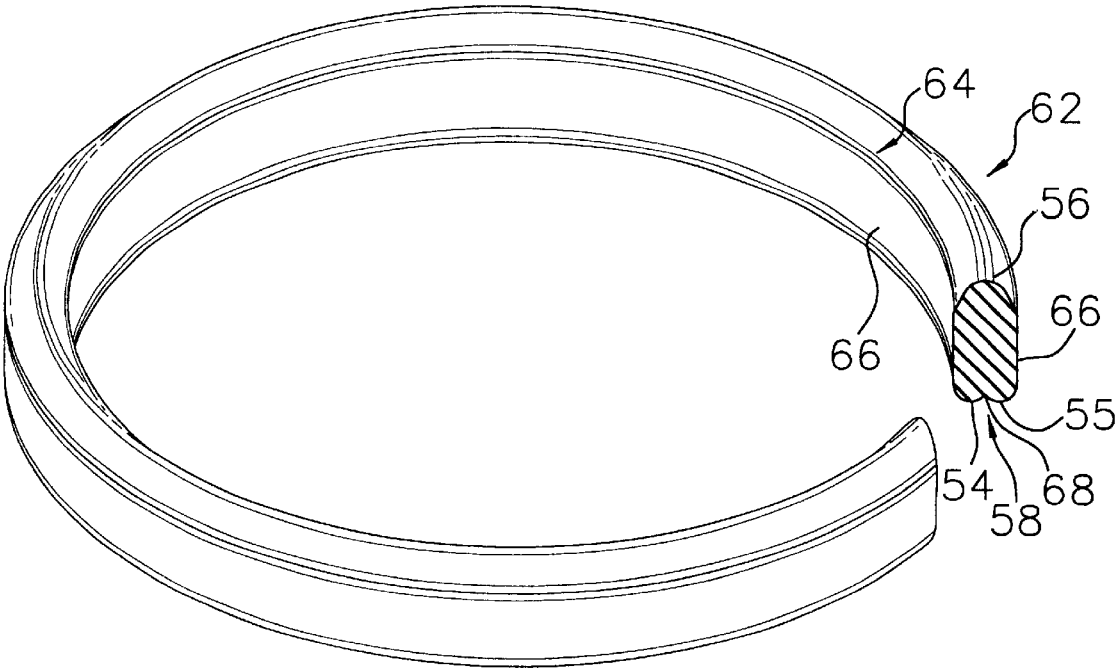
FIG. 4 is a cross-sectional view of a second seal embodiment of this invention.

FIG. 4 illustrates a second seal embodiment 62, that is designed for use in an axial sealing service, comprising a seal body 64 having a static seal surface 56, and a dynamic seal surface 58 that includes two outwardly projecting dynamic surface elements 54 and 55. The only difference from the seal illustrated in FIG. 3 is that the dynamic and static sealing surface are positioned along axial seal body surfaces to facilitate axial sealing.

The design feature of multiple dynamic seal surface elements is one that is important to achieve a desired sealing performance with a dynamic rock bit surface. Specifically, the use of these sealing elements enhance sealability by providing multiple barriers to fluid migration thereacross. The materials that is used to form each seal element, the particular seal element geometry, and the contact pressure provided by each seal element against a dynamic rock bit surface together dictate the sealability characteristics of the seal. Each seal element can be tailored to different sealing conditions, thereby providing multiple barriers to the passage or particles, abrasives, and fluids thereacross. Conventional seals having only a continuous-radius dynamic seal surface provide only a single contact pressure maxima against a dynamic rock bit surface that is now known to limit the sealing performance of the seal.

Figures 5, 6, 7, 8, 9, 10, 11:
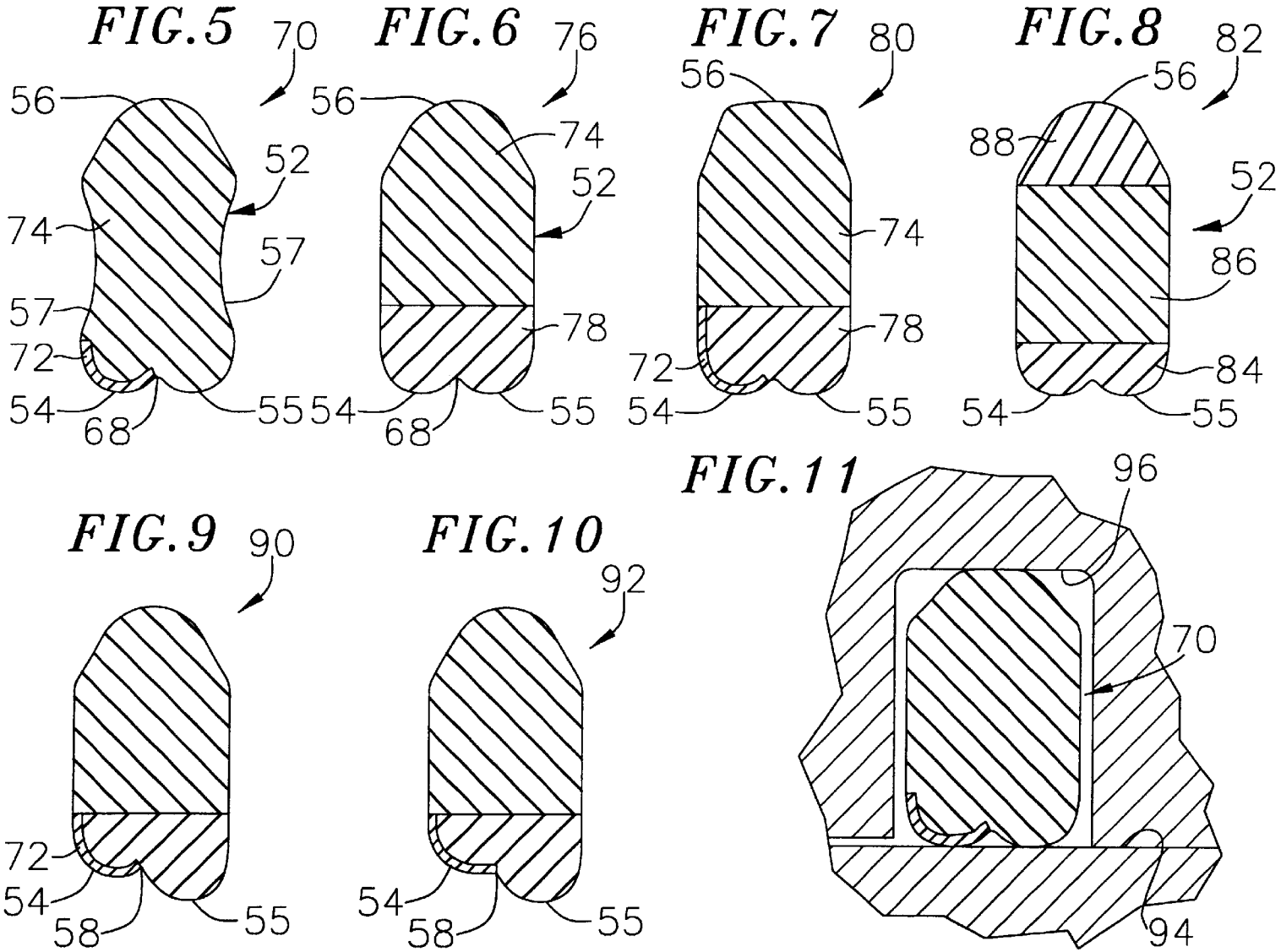
FIG. 5 is a cross-sectional view of a third seal embodiment of this invention.
FIG. 6 is a cross-sectional view of a fourth seal embodiment of this invention.
FIG. 7 is a cross-sectional view of a fifth seal embodiment of this invention.
FIG. 8 is a cross-sectional view of a sixth seal embodiment of this invention.
FIG. 9 is a cross-sectional view of a seventh seal embodiment of this invention.
FIG. 10 is a cross-sectional view of an eighth seal embodiment of this invention.
FIG. 11 is a cross-sectional view of the seal embodiment of FIG. 5 interposed between a static cone and dynamic journal surface.

In the example embodiments illustrated in FIGS. 3 and 4, the seals 33 and 62 each have a dynamic seal surface 58 comprising two surface elements 54 and 55 that are each positioned adjacent one another. Referring to FIG. 3, the seal body 52 also includes axial side or wall surfaces 57 that extend radially along each axial ring body surface between the ring body inside and outside diameters. The axial wall surfaces 57 can be planar, i.e., have a flat and parallel to one another, or can be nonplanar. For example, FIG. 5 illustrates an embodiment of the seal body having axial wall surfaces 57 that are nonplanar and, more specifically, that are each concave or dished inwardly into the seal body. This particular embodiment wall surface is useful for reducing the radial rigidity of the seal body and, thereby reducing its energizing force to a desired level. It is, however, to be understood that axial wall surfaces of seals of this invention can be other than that described or illustrated. Referring to FIG. 4, the seal body includes wall surfaces 66 that are each positioned along opposite inside and outside seal body diameters In these two example embodiments, the first and second dynamic seal surface elements 54 and 55 are each in the form of semi-circular lobes that project a distance outwardly from the seal body. Each surface element 54 and 55 has a generally rounded surface geometry, and the surface elements are separated across the face of the dynamic surface by a recessed portion 68 that is interposed therebetween. It is to be understood that the dynamic seal surface elements can be configured differently than that illustrated in FIGS. 3 and 4 as long as: (1) each can function independently to produce a contact pressure maxima against a rock bit dynamic surface; and (2) a recessed portion is formed therebetween. It is also important to note that the recessed portion 68 is a feature of the dynamic surface that may or may not be visible after the seal is loaded into the rock bit, depending on the specific dynamic surface design.

A key feature of seals of this invention comprising multiple dynamic seal surface elements for providing multiple contact pressure maximas is: (1) the ability to vary the specific geometry of each surface element to enable each element to act independently of the other to each provide a desired seal contact pressure at each different dynamic seal/rock bit interface; and (2) the ability to select different materials of construction for each dynamic seal surface element to best suit the particular operating demands at each dynamic seal surface.

Generally speaking, the dynamic interface that exists between an annular seal and a rock bit is subjected to different operating conditions at each dynamic surface edge. One dynamic surface edge is subjected to the outside environment of the drilling operation, which consists of drilling debris and fluid, while the other dynamic surface edge is subjected to the inside environment of the rock bit, which consists of the rock bit journal bearing and bearing lubricant. Accordingly, the dynamic interface that is provided by the seal dynamic surface must both protect the rock bit journal bearing against the intrusion of drilling debris and fluid across the seal in one direction, and protect the rock bit journal bearing from passing lubricant across the seal in the other direction. The occurrence of either event will result in rock bit failure.

Seal constructions of this invention comprising multiple dynamic seal surface elements allows one to tailor each dynamic seal surface element to best meet its specific service demands during rock bit operation. The dynamic seal surface element that is positioned within the rock bit adjacent the rock bit journal bearing can be designed to better meet the temperature effects of the bearing and lubricant contained within the rock bit to provide improved sealability, thus improve rock bit service life. Additionally, this seal surface element is designed to provide a seal at differential pressures across the seal surface that are higher than that experienced across the other seal surface element.

The dynamic seal surface element that is positioned adjacent the outside drilling environment can be designed to better meet the specific temperature conditions and abrasive wear conditions occurring outside of the rock bit to provide improved seal wear resistance, thus improve rock bit service life. This seal element is designed to act as a barrier primarily to abrasives to prevent passage of the same to the other seal element. Together, the different dynamic seal surface elements enable a single seal to provide multiple barriers to drilling fluids, resulting improved properties of sealability, and improved properties of wear resistance when compared to conventional seal designs having only a single dynamic seal surface element.

Seal constructions of this invention, comprising multiple dynamic surface elements, additionally include a recessed portion or discontinuity that is disposed between the surface elements. The recessed portion is designed to have a minimal contact pressure against a dynamic rock bit surface, and in some designs, can actually form a pocket between the surface elements that can entrap grease therein to lubricate the dynamic seal surface to improve seal life, thus extend sealability. Additionally, in the event that lubricant or drilling fluid disposed on respective sides of the dynamic seal passes across one of the dynamic surface elements, the recessed portion can serve as a barrier to retain the migrate material so that it is not passed across the other of the dynamic surface element.

The circumferential void or recess and resulting subsequent pressure profiles can be further modified by a projection on the leg surface (see FIGS. 15 and 17) as better described below. The discontinuity between the dynamic seal surface elements enable the achievement of independent properties associated with each dynamic surface element. Features that can be used to control these properties include the symmetry or asymmetry across the dynamic seal surface profile, the compression state of the seal (e.g., material stiffness and percent deflection), the geometry of the dynamic seal elements (e.g., circumference/radius of curvature), the resistance to wear and/or temperature, and the sealing pressure.

In general, the dynamic interface surface of a seal used in rock bit service is exposed to temperature and wear conditions that are much more extreme than that observed at other portions of the seal. For example, a seal dynamic interface surface is subjected to a high degree of wear and heat from rotation against the rock bit journal bearing surface. Under operating conditions, the dynamic interface surface is typically subjected to temperatures in the range of from about 150 to 300° C., pressures of approximately 35,000 kilopascals or greater, differential pressures across the seal of about 1,700 kilopascals, and rotational speeds varying from about 60 to about 400 rpm. Additionally, the dynamic interface surface is subjected to a highly abrasive environment of drilling fluid and hostile chemicals.

Seals of this invention can be formed from one or more different types of materials to accommodate the different operating conditions that are known to exist along different portions of the seal. FIGS. 3 thru 8 illustrate example embodiments of seals of this invention that are formed differently from one another. FIGS. 3 and 4 each illustrate a seal embodiments that are formed entirely from a single type of material, e.g., a single type of rubber or elastomeric material. In these seal embodiment, the seal dynamic surface elements 54 and 55, the seal body 52, and seal static seal surface 56 are all formed from the same type of material. This type of seal embodiment can be useful, for example, in low speed, low heat, and moderate abrasion rock bit applications where the differential pressure across the seal is sufficiently high such that improved sealability via multiple contact dynamic sealing surface elements, i.e., multiple contact pressure maximas, is required.

Elastomeric materials useful for forming the first and second seal embodiments include those selected from the group of fluoroelastomers including those available under the trade name Advanta manufactured by DuPont, carboxylated elastomers such as carboxylated nitrites, highly saturated nitrile (HSN) elastomers, nitrile-butadiene rubber (HBR), highly saturated nitrile-butadiene rubber (HNBR) and the like. Suitable elastomeric materials have a modulus of elasticity at 100 percent elongation of from about 350 to 2,000 psi (2.4 to 12 megapascals), a minimum tensile strength of from about 1,000 to 7,000 psi (6 to 42 megapascals), elongation of from 100 to 500 percent, die C tear strength of at least 100 lb/in. (1.8 kilogram/millimeter), durometer hardness Shore A in the range of from about 60 to 95, and a compression set after 70 hours at 100° C. of less than about 30 percent, and preferably less than about 16 percent. Preferred elastomeric materials are proprietary HSNs manufactured by Smith International, Inc., under the product names HSN-8A, HSN-M9, and W122.

FIG. 5 illustrates a third seal embodiment 70 of this invention comprising a dynamic seal surface having first and second surface elements 54 and 55 in the form of dual or twin lobes as illustrated in FIGS. 3 and 4. However, the third seal embodiment comprises a first dynamic seal surface element 54 that is formed from a material 72 that is different from a material 74 used to form both the second dynamic seal surface element 55 and the remaining portions of the seal body 52. In the event that the third seal embodiment is placed into seal service such that the first dynamic surface element 54 is positioned adjacent the outside drilling environment, it is desired that the first dynamic seal surface element 54 be formed from a material 72 that provides a higher degree of wear resistance than the material 74 used for the rest of the seal body because of its exposure to the hostile down hole drilling environment.

Additionally, the third seal embodiment 70 is different than that of the first and second seal embodiments in that the seal body surfaces 57, between the dynamic and static seal surface, are concave surfaces, i.e., ones that extends radially inwardly a desired radius, rather than flat or planar surfaces. The design of such concave seal surfaces is desired for certain application because it: (1) provides a greater void space with loaded within the rock bit to allow for greater grease loading and volume expansion of the elastomers under high temperatures; (2) provides lower elastomer pressure behind a wear material edge; and (3) provides a higher aspect ratio per seal package area to enable better squeeze when placed in a compressed state to improve contact pressure. It is to be understood that although the use of such concave seal body surfaces has been illustrated in the third seal embodiment of FIG. 5, that all seal embodiments of this invention can include the concave seal body surfaces.

Typically, materials that are more wear resistant are also harder or less adapt to deform. The relative deformability of a material used to form a seal relates to the ability of the seal formed from such material to form a leak-tight seal against an adjacent rock bit surface, i.e., relates to the sealability of the seal. For this reason, an advantage of this third seal embodiment is that while the harder or more wear resistant material 72 is positioned where it is needed most, at the first dynamic seal surface element 54, the second dynamic seal surface element 55 positioned adjacent the journal bearing is preferably formed from a different, relatively more deformable material 74 to provide improved sealability at its interface with the rock bit. Accordingly, a key advantage of this third seal embodiment is the use of different materials to form the different dynamic seal surface elements to optimize both properties of seal wear resistance and sealability without having to compromise one for the other, which is true with conventional seals constructed having a single dynamic seal surface that is formed from a single type of material.

The third embodiment seal body, static seal surface, and second dynamic surface element are formed from the same material 74 that is selected from the same materials discussed above for the first and second seal embodiments. Materials useful for forming the seal body first dynamic seal surface element 54 to provide improved wear resistance includes the same types of rubber and elastomeric materials discussed above that have been constructed to provide improved properties of heat resistance and/or wear resistance. For example, such materials can have a modulus of elasticity at 100 percent elongation of greater than about 4,500 kilopascals, and have a standard compression set after 70 hours at 100° C. of less than about 20 percent.

Additionally, desired rubber or elastomeric materials useful for forming the first dynamic surface element 54 include those having a durometer Shore A hardness measurement in the range of from about 75 to 95, and more preferably greater than about 80, a modulus of elasticity at 100 percent elongation of in the range of from about 700 to 2,000 psi, elongation of from about 100 to 400 percent, a tensile strength of in the range of from about 1,500 and 4,000 psi, and a compression set after 70 hours at 100° C. in the range of from about 8 to 18 percent. A material having these properties will provide improved wear resistance, abrasion resistance, friction resistance, and temperature stability to provide enhanced seal performance at the first dynamic seal surface under operating conditions, thereby extending the service life of the rock bit.

Other suitable materials useful for forming the first dynamic seal surface 54 include so called self-lubricating rubber or elastomeric compounds that include one or more lubricant additive(s) to provide enhanced properties of wear and friction resistance. Such self-lubricating compounds have the same physical properties as that described above. A preferred self-lubricating compound includes HNBR comprising one or more lubricant additive selected from the group of dry lubricants comprising graphite flake, hexagonal boron nitride (hBN) and the like, and mixtures thereof, as disclosed in U.S. patent application Ser. No. 98/943,867 filed on Oct. 8, 1997, that is incorporated herein by reference. It has been discovered that hBN or graphite flake can be used as a partial substitute for carbon black to provide strength to the elastomeric material, to reduce the coefficient of friction of the elastomeric material, and to reduce the amount of abrasive wear that is caused by the elastomeric material, i.e., to make the elastomeric seal less abrasive against the mating journal bearing surface. In an exemplary embodiment, HNBR used to form the dynamic seal comprises in the range of from about 5 to 20 percent by volume graphite flake or hBN.

In a preferred embodiment, however, the first dynamic seal surface element 54 is formed from an elastomeric composite material such as that described in U.S. Pat. No. 5,842,700, that is incorporated herein by reference. This particular composite comprises a fixed arrangement of both non-elastomeric polymeric materials and elastomeric or rubber materials. A first dynamic seal surface formed from such composite material offers key advantages when compared to dynamic seal surfaces formed from noncomposite or exclusively elastomeric materials, due to the improved degree of high-temperature endurance and stability, wear resistance, and reduced coefficient of friction afforded by the composite material.

The elastomeric component of the composite material can be selected from the same group of materials discussed above that is used to form remaining portions of the seal. It is important that the portion of the seal immediately adjacent first dynamic seal surface formed from the composite material be formed from an elastomeric material that is the same as or at least chemically compatible with the elastomeric material selected to form the composite material to ensure the formation of a permanent homogeneous bond therebetween by cross-linking reaction.

It is to be understood that the polymeric component of the composite is nonelastomeric or "elastomer free" and that the terms polymeric material and nonelastomeric polymeric material shall be used interchangeably to mean the same thing. Nonelastomeric polymeric materials are preferably in the form of fibers and include those selected from the group consisting of polyester fiber, cotton fiber, aromatic polyamines (Aramids) such as those available under the Kevlar family of compounds, polybenzimidazole (PBI) fiber, poly m-phenylene isophthalamide fiber such as those available under the Nomex family of compounds, and mixtures or blends thereof. The fibers can either be used in their independent state, or may be combined into threads or woven into fabrics and used in the resulting state. Preferred nonelastomeric polymeric materials include those having a softening point higher than about 350° F., and having a tensile strength of greater than about 10 Kpsi. Other polymeric materials suitable for use in forming composite seals include those that display properties of high-temperature stability and endurance, wear resistance, and have a coefficient of friction similar to that of those polymeric materials specifically mentioned above. If desired, glass fiber can be used to strengthen the polymeric fiber, in such case constituting a core for the polymeric fiber.

Composite materials used to form a first dynamic seal surface element of the seal preferably comprise in the range of from 10 to 90 percent by volume polymeric material. A composite material comprising less than about 10 percent by volume of the polymeric material will not produce a desired degree of high-temperature stability and endurance, and wear resistance for practical application in a rotary cone rock bit. A composite material comprising greater than about 90 percent by volume of the polymeric material will be too rigid and lack a degree of elasticity to provide a desired degree of sealability in a rock bit application. A particularly preferred composite material for use in forming the first dynamic seal surface comprises approximately 50 percent by volume polymeric material.

An exemplary nonelastomeric polymeric material is a polyester-cotton fabric having a density of approximately eight ounces per square yard. The polymeric material is provided in the form of a fabric sheet having a desired mesh size. The composite materials for use as the first dynamic seal surface is constructed by dissolving a desired quantity of the selected uncured (liquid) elastomeric material in a suitable solvent. Solvents useful for dissolving the elastomeric material include those organic solvents that are conventionally used to dissolve rubber or elastomeric materials.

A desired quantity of lubricant additive is added to the elastomer mixture. The desired nonelastomeric polymeric material is then added to the dissolved elastomeric material so that it is completely immersed in and saturated by the elastomeric material. In an exemplary embodiment, the polymeric material is in the form of a fabric sheet that is placed into contact with the elastomeric material so that the sheet is completely impregnated with the elastomeric material. Preferably, the polymeric fabric sheet is impregnated with the elastomeric material by a calendaring process where the fabric sheet is fed between two oppositely positioned rotating metal rolls that are brought together to squeeze the fabric. The rolls are configured to contain a bank of the elastomeric mixture, which is forced into the fabric weave under pressure. The metal rolls are also heated to soften the elastomeric material and, thereby improve its penetration into the fabric.

The total number of polymeric fabric sheets that are used, and that are impregnated or saturated with the elastomeric material, depends on the desired build thickness of the composite material portion of the seal. If one long fabric sheet is impregnated, the sheet is cut and stacked one on top of another to build a desired seal thickness. Alternatively, a number of shorter sheets can be impregnated, which are then stacked on top of one another. The exact number of sheets that are stacked to form a desired seal thickness depend on such factors as the type and thickness of the particular polymeric fabric that is used, as well as the particular seal construction. In the example embodiment illustrated in FIG. 5, the composite material forming the first dynamic seal surface element 54 has a thickness in the range of from about 0.3 to 2 millimeters (mm). A preferred seal embodiment has a composite material thickness of approximately 0.6 mm.

A first dynamic seal surface element 54 comprising a composite material thickness of less than about 0.3 mm may not provide the desired degree of wear resistance or temperature stability desired for application within a rotary cone rock bit. A first dynamic seal surface element 54 comprising a composite material thickness of greater than about 2 mm may be more than what is necessary to provide the desired degree of wear resistance or temperature stability desired for application within a rotary cone rock bit, thus be economically undesirable. Additionally, a composite material that is too thick may have a high modulus of elasticity that increases the rigidity of the material, which could compromise sealability and provide increased contact stress and increased friction heat at the seal surface.

In the case where the seal is formed entirely from the composite material, the impregnated fabric sheets are stacked to a desired seal radial thickness and are wound into a cylinder having an inside and outside diameter roughly equaling that of the final seal ring. The axial ends of the sheets are cut so that the seal ring has an axial thickness roughly equaling that of the final seal ring. The cut ends are sown together to form a closed loop. The sown sheets, now roughly in the form of the seal ring, are loaded into a compression mold and the mold is heated to simultaneously form the seal and cure or vulcanize the elastomeric mixture. Cross linking the elastomeric material during cure forms a seal construction made up of polymeric fabric that is strongly entrapped and bonded within the elastomeric medium.

The first dynamic seal surface element is formed from the composite material by stacking the polymeric sheets on top of one another and winding them into a cylinder having a radius of curvature that approximates that of the first dynamic seal surface element. The axial ends of the stacked sheets are cut to the approximate axial thickness of the seal ring and the cut ends are sewn to form a closed loop. The sewn sheets, now roughly in the form of the first dynamic seal surface, are placed into a portion of the mold that forms the first dynamic seal surface element. Uncured elastomeric material used to form other portions of the seal is loaded into the remaining portion of the mold, e.g., between the stacked sheets and the outside diameter of the mold, and the mold is heated and pressurized to simultaneously form the seal and cure or vulcanize both the elastomeric mixture impregnating the fabric and the added elastomeric material. During the cure process, the elastomeric mixture in the polymeric fabric undergoes cross-linking reactions both with itself to entrap the polymeric fabric within the elastomeric medium, and with the added elastomeric material to form a permanent bond with the adjacent seal material.

FIG. 6 illustrates a fourth seal embodiment 76 that comprises a dynamic seal surface including a first dynamic seal surface element 54 and a second dynamic seal surface element 55 that are both formed from a material 78 that is different from a material 74 used to form the remaining portions of the seal body 52, e.g., the static seal surface 56. In such seal embodiment, the first and second dynamic seal surface elements 54 and 55 are both preferably formed from rubber or elastomeric materials having relatively better properties of wear resistance and/or temperature stability when compared to the material 74 used to form the seal body and static seal surface. Suitable materials useful for forming the dynamic seal surface elements include those rubber and elastomeric materials disclosed above used for forming the first dynamic surface element 54 of the third seal embodiment of FIG. 5. Suitable materials useful for forming the remaining portions of the fourth seal embodiment include those rubber and elastomeric materials disclosed above used for forming the first and second seal embodiments illustrated in FIGS. 3 and 4.

The fourth seal embodiment 76 is constructed to address the different operating conditions that occur at the dynamic and static seal surfaces. Specifically, the dynamic seal surface elements are both formed from elastomeric materials that are relatively harder and more wear resistant than the remaining seal portions to accommodate the extreme temperature and wear conditions that occur at the dynamic seal interface, while the remaining portion of the seal body and static seal surface are formed from relatively softer and more deformable elastomeric materials that better enable the seal body to both act as an energizer, to provide a desired degree of contact force at the dynamic and static seal surfaces when loaded into the rock bit, and to enable the static seal surface to remain stationary against an adjacent rock bit surface.

FIG. 7 illustrates a fifth seal embodiment 80 that is similar to the fourth seal embodiment of FIG. 6, except that one of the seal dynamic surface elements, e.g., 54, is formed from the composite material 72, the other of the seal dynamic surface element, e.g., 55, is formed from the same material 78 used to form the dynamic surface elements in the fourth seal embodiment, and the remaining portion of the seal body is formed from the same material 74 used to form the remaining seal body portion of the fourth seal embodiment. The use of the composite material 72 to form one of the dynamic surface elements in this embodiment is desired to provide improved properties of wear resistance at a location that is subjected to the extreme down hole operating conditions.

FIG. 8 illustrates a sixth seal embodiment 82 having a dynamic seal surface comprising a first dynamic seal surface element 54 and a second dynamic seal surface element 55 that are both formed from a material 84 that is different from both a material 86 used to form an adjacent portion of the seal body 52, and a material 88 used to form the static seal surface 56. In this sixth seal embodiment, the first and second dynamic seal surface elements 54 and 55 are both preferably formed from rubber or elastomeric materials having relatively better properties of wear resistance and/or temperature stability when compared to the other seal materials 86 and 88. Suitable materials useful for forming the dynamic seal surface elements include those rubber and elastomeric materials disclosed above used for forming the dynamic surface elements of the fourth seal embodiment of FIG. 6. Suitable materials useful for forming the remaining portion of the seal body and static seal surface include those rubber and elastomeric materials disclosed above for forming the first seal embodiment.

The sixth seal embodiment 82 is constructed to address the different operating conditions that occur at the dynamic and static seal surfaces. However, in addition to this, the sixth seal embodiment includes a seal body portion between the dynamic and static seal surfaces that is formed from an elastomeric material tailored to provide desired seal energizing properties independent of the material properties required to meet the operating demands at the dynamic and static seal surfaces. It is desired that the material 88 selected to form the static seal surface 56 have a coefficient of friction that is greater than both materials 84 and 86. Additionally, it is desired that the material used to form the seal body and both seal surfaces each have a different modulus of elasticity and, preferably, the material selected to form the seal body has a modulus that is less than that of the material used to form the dynamic seal surface.

An advantage of this particular seal embodiment is that it allows a seal designer to select materials to form the dynamic and static seal surfaces that are best suited to meet the different operating conditions at each surface. In the two-material fourth seal embodiment, the single material that is selected to form both the seal body and static seal surface represents a compromise, as it must act both as an energizer in the seal body, to ensure that a desired degree of contact pressure is imposed by the dynamic seal surface against the bearing, and as a high-friction surface in the static seal surface, to ensure that the static seal surface is stationary and does not slip against the cone surface. The three-material seal embodiment permits a designer to select a material to form the body that provides a desired degree of contact pressure, and a material to form the static seal surface that has desired high-friction characteristics without sacrificing seal performance. Accordingly, such seal embodiment minimizes the compromise in seal performance that is known to occur when limited material choices are available.

In each of the above-described and illustrated example seal embodiments, the seal dynamic surface elements 54 and 55 have been in the form of two convex lobes. This has been done for purposes of reference and it is important to understand that seals of this invention can and are constructed having differently shaped dynamic surface elements. For example, FIG. 9 illustrates a seventh seal embodiment 90 that is similar to the fifth seal embodiment of FIG. 7, except that one of the seal dynamic surface elements, e.g., 54, has a shape that is different than that of the other dynamic surface element. Specifically, surface element 54 is in the form of a convex lobe that projects outwardly from the seal body a lesser amount than that of surface element 55.

Also, in this seventh seal embodiment, there still exists a recessed portion 58 interposed between the two surface elements that is viewable before the seal is loaded into the rock bit. The recessed portion 58 is such that it may or may not create a void between the seal and the rock bit dynamic surface in a compressed state to retain grease therein. In either case, however, the recessed portion is designed to provide a dynamic seal contact pressure minima against the rock bit dynamic surface to enable each surface element to function independently of one another.

The differently configured surface elements provide a contact pressure profile, when installed within the rock bit, that is still characterized by two distinct pressure maximas (one for each surface element). However, the contact pressure that is provided by surface element 54 is less than that provided by surface element 55. In this particular embodiment, the surface element 54 is designed to impose a higher contact pressure when in the compressed state, having a larger surface diameter, higher percentage deflection, increased sealing surface, but less wear resistance than the other surface element 55. The other surface element 55 is designed to impose a lesser contact pressure in the contact state, and comprises a wear resistant composite material along a wear surface to provide improved wear resistance, and is intended to act as an excluder of particles from surface element 54.

FIG. 10 illustrates an eighth seal embodiment 92 that is similar to the seventh seal embodiment of FIG. 9, except that the recessed portion 58 interposed between the surface elements 54 and 55 is in the form of a discontinuity, rather than in inverted valley or groove, so that it does not provide a void when compressed within a rock bit. The surface elements 54 and 55 still provide two distinct contact pressure maximas when in the compressed state. However, the recessed portion also imposes a slight contact pressure on the rock bit dynamic surface when in the compressed state.

It is important to note that in each of the above-described and illustrated seal embodiment the recessed portion is designed to separate each dynamic surface element to enable the geometric and/or material characteristics of each dynamic surface element to function independent of one another. To achieve this purpose, the recessed portion can appear in a relaxed/uncompressed state to be in the form of a groove, void, space or discontinuity between the dynamic surface elements that extend around the face of the dynamic seal surface. In a compressed state, the recessed portion may be visible in the form of a small void, space or recessed area. Alternatively, the recessed portion may not be visible in a compressed state, but appear in a contact pressure profile as a discontinuity, step change, or gradient of pressure when contrasted to the surface elements.

Having independent dynamic seal surface elements enables the seal designer to tailor the seal performance characteristics at each surface element by controlling such seal features as: (1) the symmetry of the surface elements with respect to each other; (2) the material stiffness to impact the percent deflection in a compressed state; (3) the geometry of each surface; (4) the resistance to wear and temperature; and (5) the sealing pressure.

The static seal surface 56 of each of the above-described and illustrated seal embodiments is understood to have a geometry that is not restricted. Generally, it is desired that the static surface be configured having a geometry that is designed to provide a sufficient degree of contact pressure against an adjacent stationary cone surface to keep the seal positioned stationary thereagainst. The static seal surface can have a radius of curvature that is less than or greater than the width of the seal body taken between surfaces 57.

For example, FIGS. 3 to 6, and 8 to 11, 15 and 17 each illustrate seal embodiments of this invention comprising a static seal surface having a radius of curvature that is less than the width of the seal body. In preferred embodiments of such seals, the static seal surface 56 has a radius of curvature less than about one half of or 0.5 times the axial thickness of the seal body 52 and, more preferably in the range of from about 0.1 to 0.4 times the axial thickness of the seal body. A static seal surface having a radius of curvature within this range provides a sufficient degree of contact pressure against an adjacent journal bearing surface to both prevent seal movement against the cone, and to provided a sufficient energizing force to the dynamic seal surface.

Alternatively, FIG. 7 illustrates a seal embodiment of this invention comprising a static seal surface having a radius of curvature that is greater than the width of the seal body. In this example embodiment, the seal static surface has a radius of curvature that is approximately 1.5 times that of the width of the seal body.

It is also desired that seals constructed according to principles of this invention have a radial length, as measured from the dynamic seal surfaces to the static seal surface, that acts together with the specific geometry of each seal surface to optimize the amount of contact pressure at each surface. In a preferred embodiment, the seal radial length is in the range of from about one to three times the axial thickness of the seal body. A seal having a seal radial length within this range, when combined with the preferred seal materials and dynamic and static seal radii, effectively bring the contact pressure on the dynamic seal surface within a desired low level at a fairly higher squeeze amount, which would be too large and create too large of a contact pressure for an O-ring seal, or even a high-aspect ratio seal made from a single homogeneous harder rubber.

In each of the above-described and illustrated seal embodiments the seal is configured having a generally uniform thickness, as measured axially between the static and dynamic seal surfaces, that is defined by parallel seal body walls. The thickness of the seal depends on the particular size, geometry and application of the seal. Moving from the outside diameter of the seal body 52 to the inside diameter, the static seal surface 56 flares or is tapered axially outward to form respective axial wall surfaces. In an exemplary seal embodiment, where the radius of curvature for the static seal surface 56 is approximately two millimeters and the axial thickness of the seal body is approximately five millimeters, the static seal surface flares axially toward each axial wall surface at an angle of approximately 30 degrees, as measured along an axis running between the static to the dynamic seal surface. In this particular exemplary seal embodiment, the seal has an inside diameter of approximately 50 millimeters, an outside diameter of approximately 71 millimeters, and a radial length of approximately ten millimeters.

It is to be understood that the exemplary embodiment of the seal is provided for purposes of reference and illustration, and that seals constructed according to principles of this invention can be sized differently depending on the particular application.

Seal embodiments of this invention are formed by conventional mold technique. Seal embodiments formed from more than one material are constructed by: (1) first, constructing seal subassemblies comprising each different seal portion made from different seal materials by conventional compression molding technique; (2) combining the subassemblies together, before they are allowed to fully cure, into a compression mold having an approximate configuration of the completed seal; and (3) vulcanizing the subassemblies together to form a unitary seal construction. Suitable adhesives useful for promoting bonding between the two seal assemblies include CHEMLOCK 252, manufactured by Lord Corp. To facilitate good vulcanization between the seal subassemblies, it is desired that the elastomeric materials selected to form the different seal portions be chemically compatible.

FIG. 11 illustrates the third seal embodiment 70 of FIG. 5 in its compressed state within a rock bit interposed between a dynamic journal surface 94 and a static cone surface 96. It is desired that the seal 70 have an outside diameter that is slightly larger than the diameter of the cone surface so that placement of the seal within the cone causes the seal to be circumferentially loaded therein. It is desired that, when loaded into the cone, the seal is squeezed in the range of from about 2 to 15 percent, i.e. the radial thickness of the seal is reduced by this amount. In a preferred embodiment, the seal is squeezed by approximately eight percent. Such circumferential seal loading is important because it allows for a greater contact force to be applied to the cone by the static seal surface than that applied to the journal by the dynamic seal surface, thereby minimizing any potential radial seal movement at the static surface.

Figure 12:
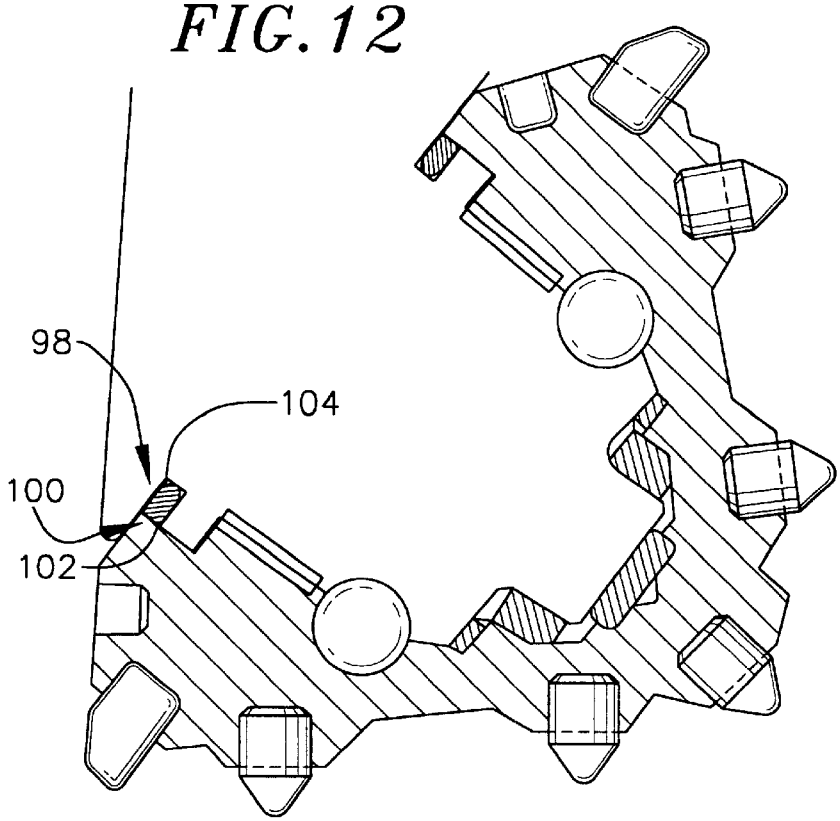
FIG. 12 is a cross-sectional view of a radial seal embodiment similar to that of FIG. 3, except that a dynamic seal surface is positioned around the seal outside diameter, interposed between a dynamic cone and static journal surface.

FIG. 12 illustrates a radial seal embodiment 98 of this invention similar to that of FIG. 3, except that the seal dynamic surface 100 is positioned along the outside diameter of the seal body, and the seal is interposed between a dynamic cone surface 102 and a static journal surface 104.

Figure 13:
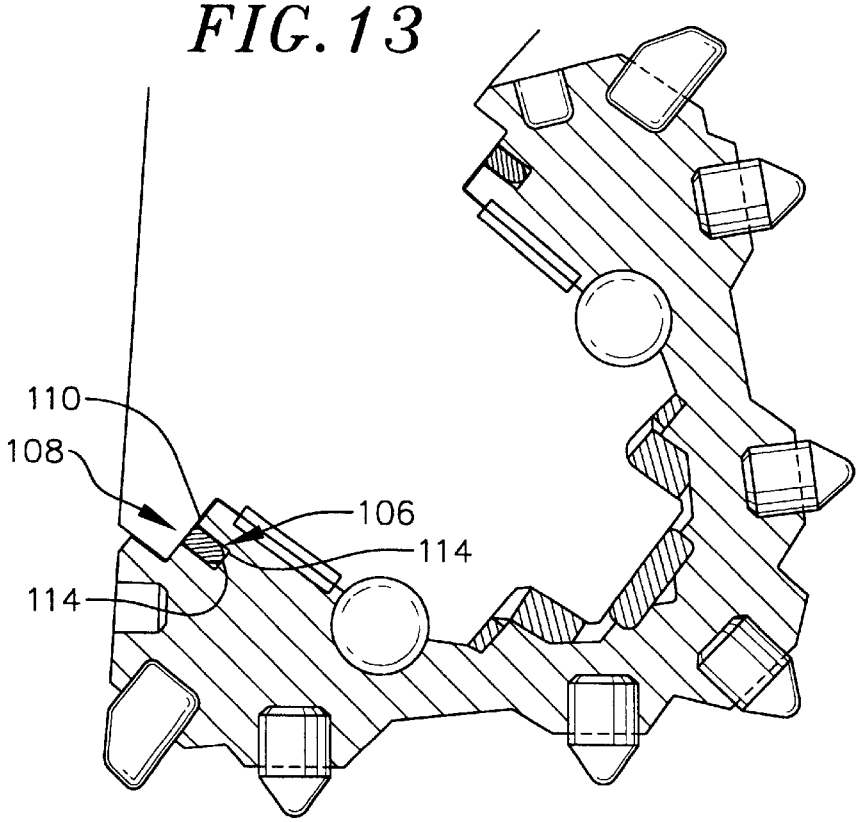
FIG. 13 is a cross-sectional view of an axial seal embodiment similar to that of FIG. 4 interposed between a static cone and dynamic journal surface.

FIG. 13 illustrates an axial seal embodiment 106 of this invention similar to that of FIG. 4, with the dynamic seal surface 108 positioned adjacent an axially-facing journal dynamic surface 110, with the static seal surface 112 positioned adjacent a static cone surface 114.

Figure 14:
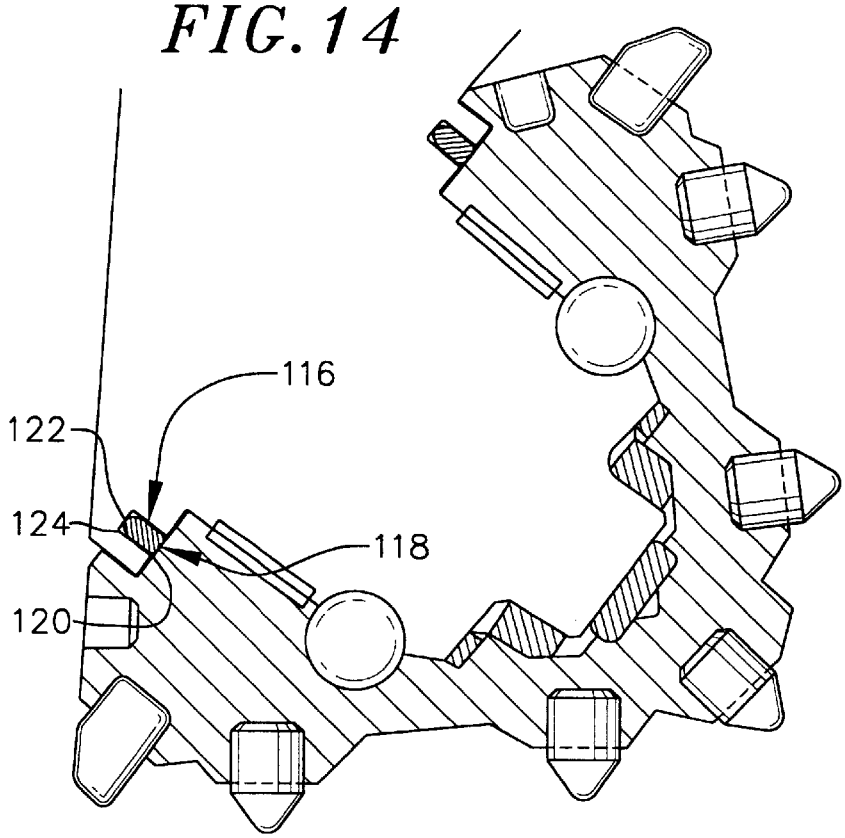
FIG. 14 is a cross-sectional view of an axial seal embodiment similar to that of FIG. 4 interposed between a dynamic cone and static journal surface.

FIG. 14 illustrates an axial seal embodiment 116 of this invention similar to that of FIG. 4, with the dynamic seal surface 118 positioned along an axially-facing cone dynamic surface 120, with the static seal surface 122 positioned adjacent a static journal surface 124.

The seal embodiments illustrated in FIGS. 11 to 15 are intended to present example that are representative, and not limiting, of the manner in which seals of this invention can be constructed to accommodate a number of different radial and axial seal services within a rock bit. It is to be understood the seals having dynamic seal surface configurations other than that illustrated can be used in the variety of illustrated radial and axial seal services.

Figure 15:
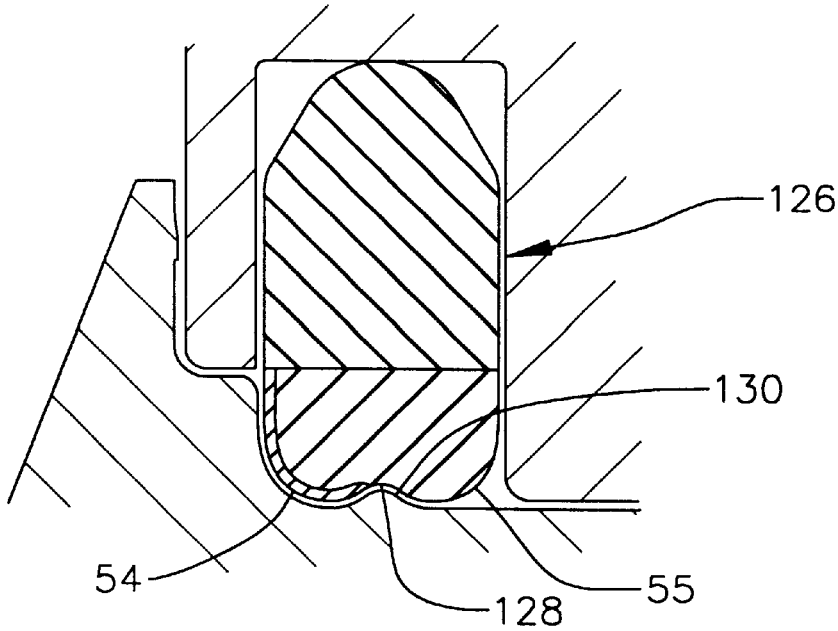
FIG. 15 is a cross-sectional view of a ninth seal embodiment of this invention interposed between a rock bit static and dynamic surface.

FIG. 15 illustrates a ninth seal embodiment 126 of this invention that is similar to the fifth seal embodiment of FIG. 7, except that the recessed portion 128 is in the form of a curved or concave section between the two dynamic seal surface elements 54 and 55. In this particular embodiment, the recessed portion 128 is designed having a radius of curvature that complements a convex mating surface of the rock bit 130. Where in the previous seal embodiments the seal dynamic surfaces have been configured to be compressed against a planar rock bit dynamic surface, certain advantages can result from using such a matched dynamic seal surface and rock bit dynamic surface configuration.

The design of a convex rock bit dynamic surface with the ninth seal embodiment provides a centering or stabilizing function to the seal that helps to minimize or eliminate the seal edges from being nibbled by contact between adjacent rock bit and cone edges. Further, the use of this matched dynamic surface design provides improved sealability because sealing contact with the rock bit occurs along the inside surfaces, i.e., along axial inside surfaces in a radial seal and along inside radial surfaces in an axial seal, of each dynamic seal surface element 54 and 55 as well as between the surface element peaks. The dynamic seal surface elements and recessed portion can be designed having a variety of different shapes to provide a number of different contact pressure profiles with a given convex rock bit dynamic surface. For example, the recessed portion can be designed so that it is more concave than the rock bit dynamic surface is convex, providing a contact pressure profile having two pressure maximas, at each surface element, separated by a relatively lower contact pressure at the recessed portion.

Figure 16:
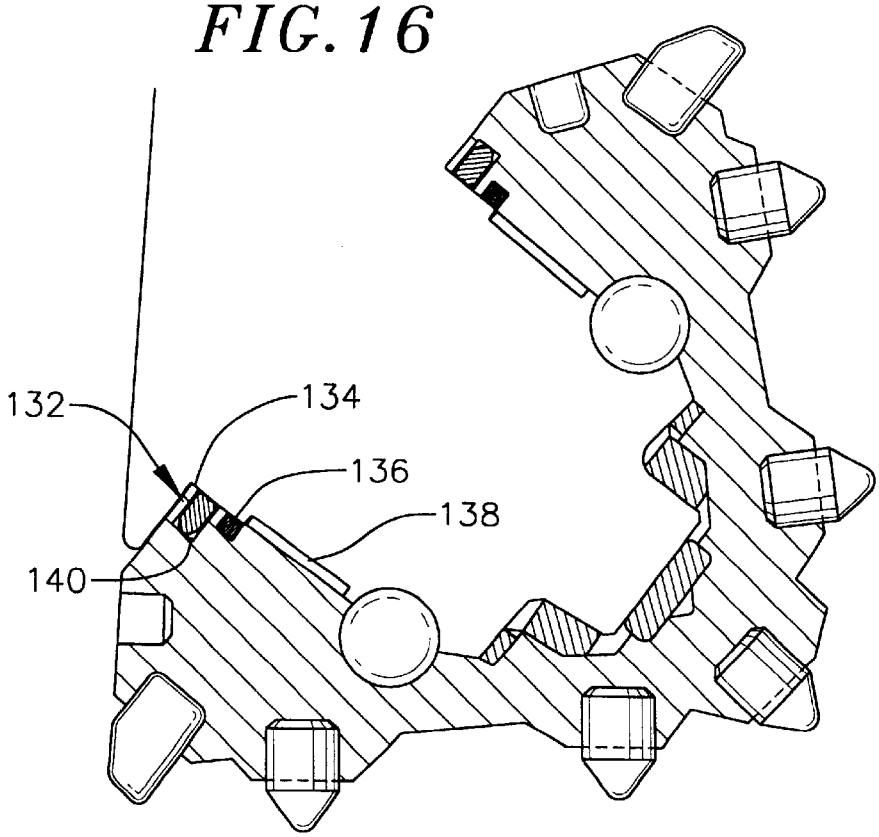
FIG. 16 is a cross-sectional view of a seal embodiment similar to that of FIG. 3 disposed within a dual seal rock bit.

FIG. 16 illustrates a seal 132 of this invention that is similar to the first seal embodiment of FIG. 3, that is disposed within a dual-seal rock bit 134 . Specifically, the rock bit comprises a first or primary seal 136 that is positioned within the rock bit adjacent a journal bearing, and the seal 132 of this invention is a second or secondary seal that is positioned next to the primary seal 136 and adjacent the outside environment. The seal 132 is disposed between a rock bit dynamic journal surface 138 and a static cone surface 140, and is used to prevent the passage of drilling debris and fluid from the outside drilling environment to the primary seal. It is to be understood that this is but one example embodiment of how seal constructions of this invention can be used in dual-seal rock bits and, as so, is not intended to be limiting.

Figure 17:
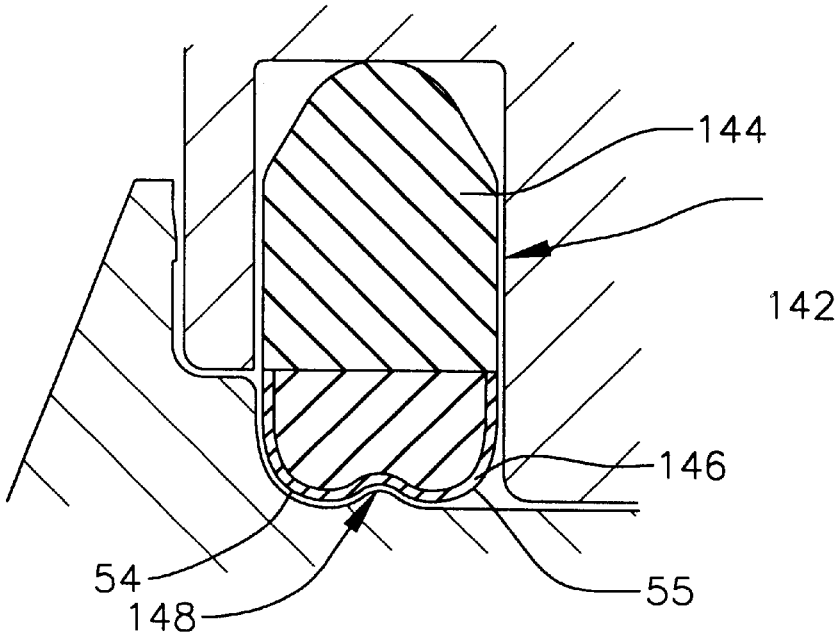
FIG. 17 is a cross-sectional view of a tenth seal embodiment of this invention.

FIG. 17 illustrates a tenth seal embodiment 142 of this invention that, unlike the other disclosed seal embodiments, comprises a multi-piece construction that is not vulcanized together. Rather, the tenth seal embodiment 142 comprises a seal body 144 that is formed from a suitable elastomeric material, e.g., one of those described above for the first and second seal embodiments, and a dynamic seal surface 146 that is formed from another materials that is relatively more wear resistant, e.g., one of the materials described above for the dynamic seal surface in the fifth seal embodiment. Suitable materials for forming multi-piece seal constructions of this invention are disclosed in U.S. patent application Ser. No. 09/283,495 filed on Apr. 1, 1999, that is incorporated herein by reference.

Multi-piece seal constructions of this invention have a dynamic seal surface 148 that is the same as that disclosed above for each of the other seal embodiments, i.e., comprising more than one dynamic seal surface elements 54 and 55, to provide two or more contact pressure maximas when loaded within a rock bit.

Multi-piece seal constructions of this invention are preferably constructed having an aspect ratio greater than one before being loaded into a rock bit. Aspect ratio as used herein is understood to refer to the ratio of the seal height, defined as the distance between the seal static and dynamic surface, to the seal width, defined as the distance across the seal dynamic surface.

Although, limited embodiments of seal constructions of this invention, having multiple dynamic seal surface elements, have been described and illustrated herein, many modifications and variations will be apparent to those skilled in the art. Accordingly, it is to be understood that, within the scope of the appended claims, seal constructions of this invention having multiple dynamic seal surface elements may be embodied other than as specifically described herein.

What is claimed is:

1. A rotary cone rock bit comprising;

a bit body;

at least one journal extending inwardly and downwardly from a lower portion of the bit body;

a cutter cone mounted for rotation on the journal; and an annular elastomeric seal forming a lubricant seal between the cone and journal, the seal having a substantially ring-shaped seal body comprising:

a dynamic seal surface disposed along one seal body portion and including two surface elements projecting outwardly therefrom prior to placement within the rock bit against a rock bit rotary dynamic surface, the surface elements being separated by a recessed portion that extends circumferentially along the dynamic seal surface, wherein the surface elements are each formed from a common elastomeric material, and wherein one of the surface elements includes a wear layer disposed thereover that is formed from a composite material comprising a fabric of nonelastomeric polymeric material that is bonded together with an elastomeric material; and a static seal surface disposed along another seal body portion.

2. The rock bit as recited in claim 1 wherein the recessed portion forms a spatial void between the dynamic surface and rock bit rotary dynamic surface, and wherein the two surface elements each provide a contact pressure profile maxima against the rock bit rotary dynamic surface.

3. The rock bit as recited in claim 1 wherein the dynamic surface element including the wear layer is positioned along a portion of the dynamic seal surface adjacent an opening between the journal and cone to the outside environment.

4. The rock bit as recited in claim 1 wherein the fabric material is formed from fibers selected from the group consisting of aromatic polyamides, polybenzimidazoles, poly m-phenylene isophthalamide, polyester, cotton, and combinations thereof.

5. The rock bit as recited in claim 1 wherein the dynamic surface elements each project outwardly a different distance away from the seal body prior to installation within the rock bit.

6. The rock bit as recited in claim 1 wherein the seal dynamic surface is formed from a material different than that used to form the seal body.

7. The rock bit as recited in claim 1 wherein the recessed portion does not form a spatial void between the seal dynamic surface and the rock bit rotary dynamic surface when installed within the rock bit.

8. The rock bit as recited in claim 1 wherein the recessed portion forms a spatial void between the seal dynamic surface and the rock bit rotary dynamic surface when installed within the rock bit.

9. The rock bit as recited in claim 8 wherein each dynamic surface element provides a distinct and independent contact pressure profile maxima against the rock bit rotary dynamic surface.

10. The rock bit as recited in claim 9 wherein the contact pressure profile maximas are equal.

11. The rock bit as recited in claim 9 wherein the contact pressure profile maximas are different.

12. The rock bit as recited in claim 1 wherein each dynamic surface element has the same circumferential diameter before installation within the rock bit.

13. The rock bit as recited in claim 12 wherein each dynamic surface element provides a different contact pressure.

14. The rock bit as recited in claim 1 wherein each dynamic surface element has a different circumferential diameter before installation within the rock bit.

15. The rock bit as recited in claim 14 wherein each dynamic surface element has the same circumferential diameter after installation within the rock bit.

16. The rock bit as recited in claim 15 wherein each dynamic surface element provides the same contact pressure against the rock bit rotary dynamic surface.

17. The rock bit as recited in claim 15 wherein each dynamic surface element provides a different contact pressure against the rock bit rotary dynamic surface.

18. The rock bit as recited in claim 1 wherein the rock bit rotary dynamic surface comprises a raised portion that is positioned adjacent the seal recessed portion.

19. The rock bit as recited in claim 18 wherein the rock bit raised portion is sized and shaped to match the seal recessed portion when installed within the rock bit.

20. The rock bit as recited in claim 18 wherein the rock bit raised portion is sized and shaped to match the seal recessed portion prior to installation within the rock bit.

21. The rock bit as recited in claim 18 wherein the dynamic surface elements provide discontinuous contact pressure profiles when installed within the rock bit that form different sealing surfaces.

22. A rotary cone rock bit comprising:

a bit body;

at least one journal extending inwardly and downwardly from a lower portion of the bit body;

a cutter cone mounted for rotation on the journal; and an annular elastomeric seal ring forming a lubricant seal between the cone and journal, the seal ring comprising:

a seal body having a dynamic seal surface at one body location and a static seal surface at another body location, wherein the dynamic seal surface comprises at least two surface elements that each project outwardly a distance away from the seal body for placement against a rock bit rotary dynamic surface, and wherein seal dynamic surface comprises a recessed portion prior to installation within the rock bit that extends circumferentially around the dynamic seal surface between the surface elements, wherein the dynamic surface elements are integral with one another and each formed from a common elastomeric material, and wherein the seal ring has an aspect ratio greater than one.

23. The rock bit as recited in claim 22 wherein the seal ring static seal surface has a single surface element that projects outwardly against a rock bit static surface.

24. The rock bit as recited in claim 22 wherein at least one of the dynamic surface elements comprises a wear layer disposed thereover that is formed from a composite material comprising a fabric of nonelastomeric polymeric material that is bonded together with an elastomeric material.

25. The rock bit as recited in claim 24 wherein the composite material has a thickness in the range of from about 0.2 to 3 millimeters.

26. The rock bit as recited in claim 22 wherein the seal dynamic surface comprises two surface elements, wherein at least one of the surface elements comprises a wear layer disposed thereover that is formed from a material that is more wear resistant than the material used to form the remaining portion of the dynamic seal surface.

27. The rock bit as recited in claims 24 or 26 wherein the wear layer is positioned along a radial surface of the dynamic surface element.

28. The rock bit as recited in claims 24 or 26 wherein the wear layer is positioned along an axial surface of the dynamic surface element.

29. The rock bit as recited in claim 26 wherein the material used to form the wear layer is a fabric of nonelastomeric polymeric material that is bonded together with an elastomeric material.

30. The rock bit as recited in claim 22 wherein the static seal surface is formed from an elastomeric material that is different than one used to form the dynamic seal surface.

31. The rock bit as recited in claim 30 wherein at least one of the dynamic surface elements includes a wear layer disposed thereover, and wherein at least a portion of the wear layer is formed from a fabric of nonelastomeric polymeric material that is bonded together with an elastomeric material.

32. The rock bit as recited in claim 22 wherein the recessed portion does not form a spatial void between the seal dynamic surface and the rock bit rotary dynamic surface when installed within the rock bit.

33. The rock bit as recited in claim 22 wherein the dynamic surface elements provide different contact pressures against the rock bit rotary dynamic surface.

34. The rock bit as recited in claim 22 wherein each dynamic surface element provides a contact pressure profile maxima against the rock bit rotary dynamic surface.

35. The rock bit as recited in claim 22 wherein the recessed portion forms a spatial void between the seal dynamic surface and the rock bit rotary dynamic surface when installed within the rock bit.

36. The rock bit as recited in claim 35 wherein each dynamic surface element provides a distinct and independent contact pressure profile maxima against the rock bit rotary dynamic surface.

37. The rock bit as recited in claim 36 wherein the contact pressure profile maximas are equal.

38. The rock bit as recited in claim 36 wherein the contact pressure profile maximas are different.

39. The rock bit as recited in claim 22 wherein each dynamic surface element has the same circumferential diameter before installation within the rock bit.

40. The rock bit as recited in claim 39 wherein each dynamic surface element provides a different contact pressure.

41. The rock bit as recited in claim 22 wherein each dynamic surface element has a different circumferential diameter before installation within the rock bit.

42. The rock bit as recited in claim 41 wherein each dynamic surface element has the same circumferential diameter after installation within the rock bit.

43. The rock bit as recited in claim 42 wherein each dynamic surface element provides the same contact pressure against the rock bit rotary dynamic surface.

44. The rock bit as recited in claim 42 wherein each dynamic surface element provides a different contact pressure against the rock bit rotary dynamic surface.

45. The rock bit as recited in claim 22 wherein the rock bit rotary dynamic surface comprises a raised portion that is positioned adjacent the seal recessed portion.

46. The rock bit as recited in claim 45 wherein the rock bit raised portion is sized and shaped to match the seal recessed portion when installed within the rock bit.

47. The rock bit as recited in claim 45 wherein the rock bit raised portion is sized and shaped to match the seal recessed portion prior to installation within the rock bit.

48. The rock bit as recited in claim 45 wherein the dynamic surface elements provide discontinuous contact pressure profiles when installed within the rock bit that form different sealing surfaces.

49. The rock bit as recited in claim 22 wherein the seal dynamic surface is formed from a material that is different than that used to form the seal body, and wherein the seal dynamic surface is not vulcanized to the seal body.

50. A rotary cone rock bit comprising:

a bit body;

at least one journal extending inwardly and downwardly from a lower portion of the bit body;

a cutter cone mounted for rotation on the journal; and an annular elastomeric seal ring forming a lubricant seal between the cone and journal, the seal ring comprising:

a seal body having a dynamic seal surface at one body location and a static seal surface at another body location, wherein the dynamic seal surface comprises at least two surface elements that each project outwardly a distance away from the seal body for placement against a rock bit rotary dynamic surface, the seal dynamic surface comprising a recessed portion prior to installation within the rock bit that extends circumferentially around the dynamic seal surface between the surface elements, wherein the dynamic surface elements are integrally formed from a common elastomeric material that is different than a material that is used to form the seal body, and wherein at least one of the surface elements has a wear layer disposed thereover that is formed from a composite comprising a fabric of nonelastomeric polymeric material that is bonded together with an elastomeric material.

51. The rock bit as recited in claim 50 wherein the fabric material is formed from fibers selected from the group consisting of aromatic polyamides, polybenzimidazoles, poly m-phenylene isophthalamide, polyester, cotton, and combinations thereof.

52. The rock bit as recited in claim 50 wherein dynamic seal surface comprises two surface elements, and the elastomeric material that is used to form the dynamic seal surface elements is relatively harder than that used to form the seal body.

53. A rotary cone rock bit comprising:

a bit body;

at least one journal extending inwardly and downwardly from a lower portion of the bit body;

a cutter cone mounted for rotation on the journal; and an annular elastomeric seal ring forming a lubricant seal between the cone and journal, the seal-ring comprising:

a seal body having a dynamic seal surface at one body location and a static seal surface at an opposite body location, wherein the dynamic seal surface comprises at least two surface elements that project outwardly therefrom before being installed within the rock bit, the surface elements being separated by a recessed portion that extends circumferentially around the dynamic seal surface;

wherein one of the cutter cone or journal includes a rotary dynamic surface that is placed against the seal dynamic surface, the rotary dynamic surface having a raised portion that extends circumferentially therearound and that cooperates with the seal recessed portion.

54. The rock bit as recited in claim 53 wherein the seal ring has an aspect ratio greater than one.

55. The rock bit as recited in claim 53 wherein the dynamic seal surface comprises two surface elements that are formed from the same material that is different from that used to form the seal body.

56. The rock bit as recited in claim 53 wherein at least one of the dynamic surface elements includes a wear surface that is formed from a material that is more wear resistant than the materials used to form the other portions of the seal.

57. The rock bit as recited in claim 56 wherein the wear surface is formed from a composite material comprising a fabric of nonelastomeric polymeric material that is bonded together with an elastomeric material.

58. The rock bit as recited in claim 57 wherein the fabric material is formed from fibers selected from the group consisting of aromatic polyamides, polybenzimidazoles, poly m-phenylene isophthalamide, polyester, cotton, and combinations thereof.

59. A rotary cone rock bit comprising;

a bit body;

at least one journal extending inwardly and downwardly from a lower portion of the bit body;

a cutter cone mounted for rotation on the journal; and an annular elastomeric seal forming a lubricant seal between the cone and journal, the seal having a substantially ring-shaped seal body comprising:

a dynamic seal surface disposed along one seal body portion and including two surface elements projecting outwardly therefrom prior to placement within the rock bit against a rock bit rotary dynamic surface, the surface elements being separated by a recessed portion that extends circumferentially along the dynamic seal surface, wherein the surface elements are each formed from the same material, and wherein one of the surface elements includes a wear surface disposed thereon that is formed from a composite material comprising a fabric of nonelastomeric polymeric material that is bonded together with an elastomeric material, wherein the rock bit rotary dynamic surface comprises a raised portion that is positioned adjacent the seal recessed portion; and a static seal surface disposed along another seal body portion.

60. The rock bit as recited in claim 59 wherein the rock bit raised portion is sized and shaped to match the seal recessed portion when installed within the rock bit.

61. The rock bit as recited in claim 59 wherein the rock bit raised portion is sized and shaped to match the seal recessed portion prior to installation within the rock bit.

62. The rock bit as recited in claim 59 wherein the dynamic surface elements provide discontinuous contact pressure profiles when installed within the rock bit that form different sealing surfaces.

63. A rotary cone rock bit comprising:

a bit body;

at least one journal extending inwardly and downwardly from a lower portion of the bit body;

a cutter cone mounted for rotation on the journal; and an annular elastomeric seal ring forming a lubricant seal between the cone and journal, the seal ring comprising:

a seal body having a dynamic seal surface at one body location and a static seal surface at another body location, wherein the dynamic seal surface comprises at least two surface elements that each project outwardly a distance away from the seal body for placement against a rock bit rotary dynamic surface, and wherein seal dynamic surface comprises a recessed portion prior to installation within the rock bit that extends circumferentially around the dynamic seal surface between the surface elements, wherein at least one of the surface elements is formed from the same material as the seal body or as another surface element, and wherein the seal ring has an aspect ratio greater than one;

wherein the rock bit rotary dynamic surface comprises a raised portion that is positioned adjacent the seal recessed portion.

64. The rock bit as recited in claim 63 wherein the rock bit raised portion is sized and shaped to match the seal recessed portion when installed within the rock bit.

65. The rock bit as recited in claim 63 wherein the rock bit raised portion is sized and shaped to match the seal recessed portion prior to installation within the rock bit.

66. The rock bit as recited in claim 63 wherein the dynamic surface elements provide discontinuous contact pressure profiles when installed within the rock bit that form different sealing surfaces.

67. A rotary cone rock bit comprising:

a bit body;

at least one journal extending inwardly and downwardly from a lower portion of the bit body;

a cutter cone mounted for rotation on the journal; and an annular elastomeric seal ring forming a lubricant seal between the cone and journal, the seal ring comprising:

a seal body having a dynamic seal surface at one body location and a static seal surface at another body location, wherein the dynamic seal surface comprises at least two surface elements that each project outwardly a distance away from the seal body for placement against a rock bit rotary dynamic surface, and wherein seal dynamic surface comprises a recessed portion prior to installation within the rock bit that extends circumferentially around the dynamic seal surface between the surface elements, wherein at least one of the surface elements is formed from the same material as the seal body or as another surface element, and wherein the seal ring has an aspect ratio greater than one;

wherein the seal dynamic surface is formed from a material that is different than that used to form the seal body, and wherein the seal dynamic surface is not vulcanized to the seal body.

* * * * *